US010766651B2

(12) United States Patent
Pettersson et al.

(10) Patent No.: US 10,766,651 B2
(45) Date of Patent: Sep. 8, 2020

(54) PACKAGING MATERIAL AS A PICK ITEM

(71) Applicant: PACKSIZE LLC, Salt Lake City, UT (US)

(72) Inventors: Niklas Pettersson, Vasteras (SE); Ryan Osterhout, West Haven, UT (US)

(73) Assignee: PACKSIZE LLC, Salt Lake City, UT (US)

( * ) Notice: Subject to any disclaimer, the term of this patent is extended or adjusted under 35 U.S.C. 154(b) by 531 days.

(21) Appl. No.: 14/909,913

(22) PCT Filed: Jul. 31, 2014

(86) PCT No.: PCT/US2014/049179

§ 371 (c)(1),
(2) Date: Feb. 3, 2016

(87) PCT Pub. No.: WO2015/020879

PCT Pub. Date: Feb. 12, 2015

(65) Prior Publication Data

US 2016/0176562 A1 Jun. 23, 2016

Related U.S. Application Data

(60) Provisional application No. 61/862,499, filed on Aug. 5, 2013.

(51) Int. Cl.
*B65B 43/08* (2006.01)

(52) U.S. Cl.
CPC ..... *B65B 43/08* (2013.01); *B65B 2210/04* (2013.01)

(58) Field of Classification Search
CPC ..... B65B 2210/04; B65B 43/08
(Continued)

(56) References Cited

U.S. PATENT DOCUMENTS 6,519,916 B1 * 2/2003 Brown ..... B65G 51/02 53/403
6,721,762 B1 * 4/2004 Levine ..... G06Q 10/04
(Continued)

FOREIGN PATENT DOCUMENTS

CN 1265628 9/2000
CN 101583866 11/2009
(Continued)

OTHER PUBLICATIONS

International Search Report and Written Opinion, PCT/US2014/049179, United Search Authority, dated Oct. 28, 2014.
(Continued)

*Primary Examiner* — Dariush Seif
(74) *Attorney, Agent, or Firm* — Workman Nydegger

(57) ABSTRACT

Treating packaging as a pick item. Embodiments include methods, systems, and computer program products for determining a container size of a container for packaging one or more items. An identity of one or more items that are to be packaged into a container is received. Corresponding three-dimensional dimensions of each of the one or more items are identified. A container size of the container is calculated based on the corresponding three-dimensional dimensions of each of the one or more items. The calculated container size is configured to accommodate all of the one or more items within the container. The container is produced, the container having at least the calculated size. In some embodiments, the container can then be sent to a pack station as a pick item.

27 Claims, 3 Drawing Sheets

(58) Field of Classification Search
USPC ..... 53/452, 503, 504
See application file for complete search history.

(56) References Cited

U.S. PATENT DOCUMENTS

| | | | | |
|---|---|---|---|---|
| 7,050,938 | B1 * | 5/2006 | Prater | G06Q 10/087 702/174 |
| 7,504,949 | B1 | 3/2009 | Rouaix | |
| 7,647,752 | B2 * | 1/2010 | Magnell | B65B 5/02 493/52 |
| 7,774,243 | B1 * | 8/2010 | Antony | G06Q 10/0875 414/243 |
| 8,086,344 | B1 * | 12/2011 | Mishra | G06Q 30/0283 700/214 |
| 2001/0017023 | A1 * | 8/2001 | Armington | B65B 61/22 53/472 |
| 2002/0104293 | A1 * | 8/2002 | Armington | B65B 55/20 53/472 |
| 2003/0083890 | A1 * | 5/2003 | Duncan | B65D 5/5035 705/28 |
| 2003/0200111 | A1 * | 10/2003 | Damji | G06Q 10/08 705/335 |
| 2004/0151068 | A1 * | 8/2004 | Carlsruh | G01B 11/026 367/99 |
| 2005/0055987 | A1 * | 3/2005 | White, Jr. | B31D 5/0073 53/495 |
| 2008/0020916 | A1 * | 1/2008 | Magnell | B65B 5/02 493/65 |
| 2008/0092488 | A1 * | 4/2008 | Gabrielsen | B65B 55/20 53/428 |
| 2008/0141625 | A1 * | 6/2008 | Bilkie | B65B 55/20 53/396 |
| 2008/0229708 | A1 * | 9/2008 | Schulte | B65B 5/06 53/167 |
| 2008/0307756 | A1 * | 12/2008 | Meessen | B31D 5/0043 53/473 |
| 2009/0149306 | A1 * | 6/2009 | Durand | B65B 5/024 493/355 |
| 2009/0173040 | A1 * | 7/2009 | Carlson | B65B 55/20 53/250 |
| 2009/0308965 | A1 * | 12/2009 | Piucci | B26D 5/20 242/526 |
| 2010/0089011 | A1 | 4/2010 | Armington et al. | |
| 2010/0199599 | A1 | 8/2010 | Bonnain et al. | |
| 2011/0016833 | A1 * | 1/2011 | Carlson | B65B 55/20 53/473 |
| 2012/0206155 | A1 | 8/2012 | Wang et al. | |
| 2013/0000252 | A1 * | 1/2013 | Pettersson | B65B 5/024 53/396 |
| 2013/0026173 | A1 * | 1/2013 | Renjilian | B65B 61/22 221/1 |
| 2013/0067865 | A1 * | 3/2013 | Maruo | B65B 11/00 53/461 |
| 2013/0204419 | A1 * | 8/2013 | Pettersson | G06F 17/50 700/97 |
| 2013/0247519 | A1 * | 9/2013 | Clark | B65B 57/00 53/452 |
| 2014/0067104 | A1 * | 3/2014 | Osterhout | G06Q 50/28 700/97 |
| 2015/0005926 | A1 * | 1/2015 | Pettersson | B65B 43/265 700/228 |
| 2015/0013277 | A1 * | 1/2015 | Brandhorst | B65B 35/18 53/475 |
| 2018/0130015 | A1 * | 5/2018 | Jones | B65B 1/385 |

FOREIGN PATENT DOCUMENTS

| | | |
|---|---|---|
| CN | 102753442 | 10/2012 |
| CN | 103068564 | 4/2013 |
| EP | 2828073 | 1/2015 |
| JP | H0717611 | 1/1995 |
| JP | 2003175918 | 6/2003 |
| JP | 2005507838 | 3/2005 |
| JP | 2013513869 | 4/2013 |
| JP | 2013539103 | 10/2013 |
| JP | 2015518591 | 7/2015 |
| WO | 2011072253 | 6/2011 |
| WO | 2012018859 | 2/2012 |
| WO | 2012082980 | 6/2012 |
| WO | 2013122999 | 8/2013 |
| WO | 2013142106 | 9/2013 |

OTHER PUBLICATIONS

Search Report issued in European Application No. 14835031.7 dated Mar. 7, 2017.

* cited by examiner

PACKAGING MATERIAL AS A PICK ITEM

CROSS-REFERENCE TO RELATED APPLICATIONS

This application claims priority to and the benefit of PCT Application No. PCT/US2014/049179, filed Jul. 31, 2014, entitled "PACKAGING MATERIAL AS A PICK ITEM", which claims the benefit of and priority to U.S. Provisional Application No. 61/862,499, filed Aug. 5, 2013, entitled "PACKAGING MATERIAL AS A PICK ITEM". All the aforementioned applications are incorporated by reference herein in their entirety.

BACKGROUND

In the fulfillment industry, goods are often stored in a warehouse or distribution center, where they are picked, packed, and shipped to meet the content requirements of a specific order. Using conventional packing means, order fulfillment typically involves a human operator receiving an order, selecting (and possibly assembling) a shipping container (e.g., a corrugated fiberboard box), picking goods (e.g., from warehouse shelves), packing the goods in the shipping container, and sealing and otherwise preparing the packed container for shipment. In another example, a fulfillment center may include a number of packing stations, where a human operator receives pre-picked goods (e.g., goods picked by another human), selects (and possibly assembles) a shipping container, moves the pre-picked goods into the shipping container, and seals and otherwise prepares the packed container for shipment. Conventional packing mechanisms employ little, if any, automation and can require a large number of pack stations.

Recent developments in packaging technology have improved the cost-efficiency of the fulfillment process. For example, the ON-DEMAND PACKAGING (ODP) system from PACKSIZE INTERNATIONAL dynamically produces containers that are custom-sized for a particular order, while optimizing use of packaging material (e.g., corrugated fiberboard). FIG. 1 illustrates an example fulfillment station 100 that includes an ODP system 101, and which enables an operator to produce custom-sized containers during the packing process. Enabling an operator to custom-generate containers that are sized for the items being packaged can greatly reduce the amount of packaging material that is used during the fulfillment process, can reduce the amount of filler/protective material used during packaging, and can reduce freight costs (e.g., postage, shipping) through use of smaller shipping containers that are well-suited for the items packaged therein. A high-volume fulfillment operation may include a number of fulfillment stations that each includes an ODP system.

Even with the efficiencies that ODP systems provide in terms of freight and packaging material savings, there remain inefficiencies in terms of human error in using ODP systems, idle time spent by ODP systems while an operator is performing his or her tasks, and other capital considerations. For example, the quality of the manual work performed by human operators is to some degree dependent on quick on-the-fly decisions made by the operator (e.g., the size of container needed for a particular order). Poor operator decisions may result in shipping containers that are too big, which can then lead to excessive freight costs and the excessive use of protective filling. Poor operator decisions may also result in too small shipping containers, which can then lead to insufficient use of protective filling.

In another example, often a quality assurance process is followed by operators, such as scanning a barcode of all individual items in an order to ensure that all items in the order are correct and accounted for. The time spent on these quality assurance processes reduces the throughput of on-demand container generation devices, since they may sit idle until the packer is ready to generate a new container. For example, depending on the number of items in an order, it may take a human operator several minutes to package a single order. During this time, an ODP system, which may be capable of producing a new container every few seconds, may be sitting idle. In addition, cycle times (i.e., the time taken by a human operator to complete an order) may vary by order and/or by human operator, leading to unpredictability in the throughput of a given ODP system.

In yet another example, the space occupied by ODP systems, packaging material, and other associated hardware and supplies occupies valuable space when there are a large number of packing stations and when there is an ODP system, packaging material, etc. at each packing station. As such, fulfillment centers must devote relatively large amounts of space to packing stations. Such space may be better used for storing inventory or for other purposes. Further, use of an ODP system at each packing station may tie up significant capital in terms of equipment value.

In view of the foregoing, there remains room for improvement in the field of fulfillment.

BRIEF SUMMARY

At least some embodiments described herein relate to treating packaging as a pick item. For example, embodiments may include generating or selecting a container for packing one or more items of an order, and sending the generated/selected container to a pack station along with the item(s) that are to be packed into the container. Embodiments can improve efficiency by reducing time to select a packaging container, permitting consolidation of container generation hardware, and focusing the tasks performed by a human operator, among other things.

In some embodiments, an identity of one or more items that are to be packaged into a container is received. Corresponding three-dimensional dimensions of each of the one or more items are identified. A container size of the container is calculated based on the corresponding three-dimensional dimensions of each of the one or more items. The calculated container size is configured to be substantially equal to the size of the group of one or more items so that the container accommodates all of the one or more items within the container.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
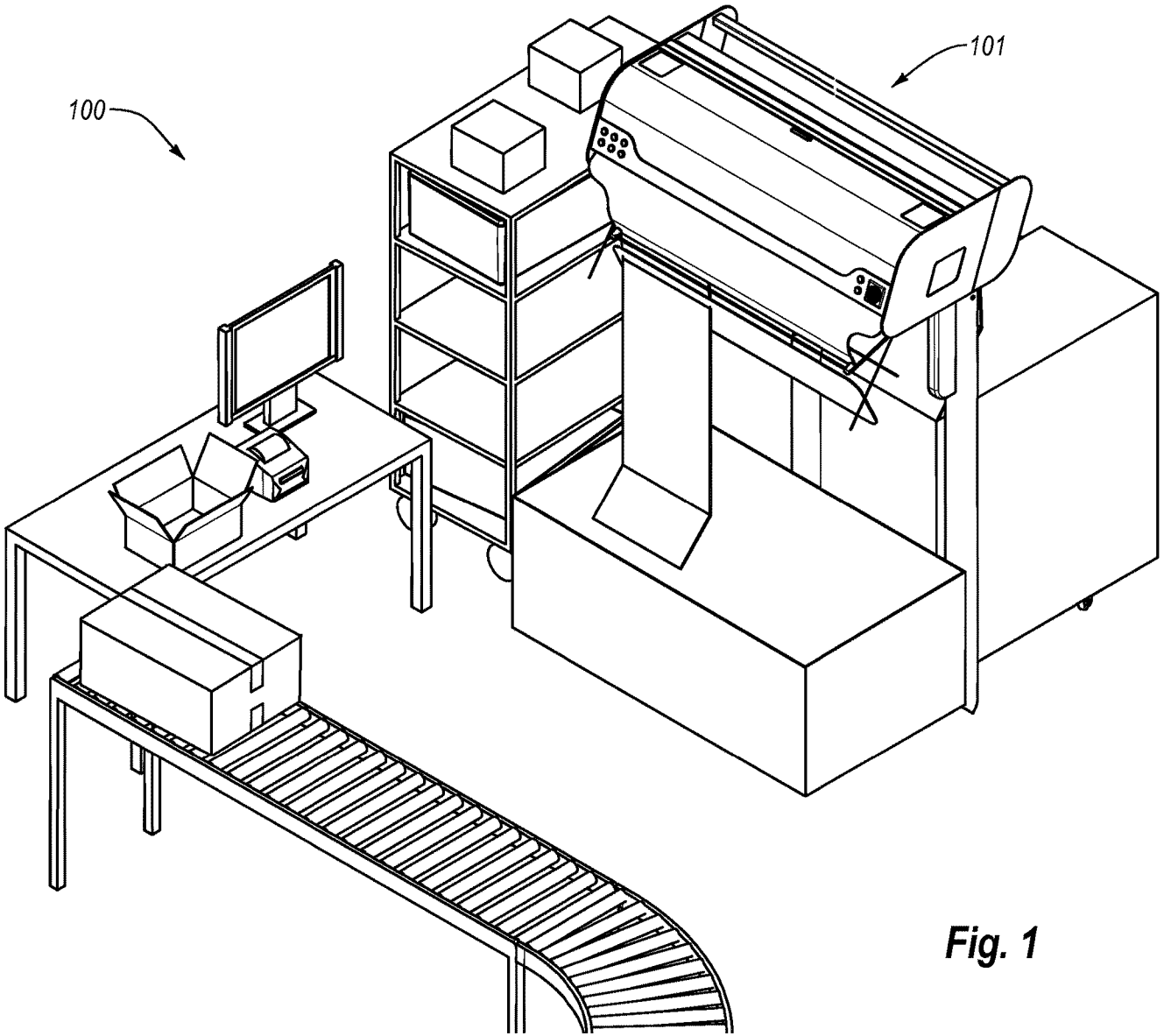
FIG. 1 is a perspective view of a fulfillment station that includes an ODP system.

At least some embodiments described herein relate to treating packaging (e.g., containers, filler and protective material, marking, documents) as a pick item. For example, embodiments may include generating or selecting a container for packing one or more items of an order, and sending the generated/selected container to a pack station along with the item(s) that are to be packed into the container. Embodiments can improve efficiency by reducing time to select a packaging container, permitting consolidation of container generation hardware, and focusing the tasks performed by a human operator, among other things.

For example, embodiments can include a system whereby, when an order is received, one or more items of the order are picked/retrieved from an inventory. In addition, a packaging container of particular size to contain the one or more items (and potentially filler and/or protective material) is also picked/retrieved. The one or more items and the packaging container (and potentially the filler and/or protective material) may be delivered to a pack station at substantially the same time. Furthermore, in case of having more orders cued up in front of the pack station, the packaging may be synced with the orders in a first-in first-out principle. In some embodiments, the foregoing is performed in an automated manner, such as by machinery that picks the item(s) and that picks and/or generates the packaging container. In some embodiments the items of an order are picked into a temporary internal carrier, which then meets the picked/retrieved packaging container at the pack station. In case the carrier can carry more orders, the packaging may be sorted in the same way. This can be the case for bigger totes/bins, as well as carts and pallets and the like. In other embodiments, the items of an order are picked into the picked/retrieved packaging container, which is then sent to the pack station. Such embodiments are useful for providing an automated system that utilizes ODP systems, providing a sequenced flow and/or sequencing of goods and packaging to pack stations.

More particularly, embodiments are directed to mechanisms that can centralize certain packaging-related machinery, such as ODP stations, filler and protective material dispensers, printers, etc., thereby removing that machinery from packing stations and removing a signification amount of work from the packing stations, so that human operators can focus on the task of packing and increase the labor efficiency and throughput in the packing station, and thereby of the whole system, i.e. enabling fewer stations than otherwise. Centralization of machinery provides the ability to balance the work of that machinery among different packing stations, as opposed to having the machinery sitting idle at each packing station. As such, throughput of each unit of machinery is increased and use of each unit is balanced out over varying cycle times of human operators at pack stations. In addition, centralization of machinery enables a fulfillment center to operate on fewer units of that machinery, thus tying up less capital, and enables a fulfillment center to remove the machinery and its associated materials (e.g., corrugated fiberboard, filler material, ink, paper, RFID tags) from occupying space at each packing station. Furthermore, centralization of machinery can provide better opportunities for efficient automation.

To the accomplishment of the foregoing, embodiments are directed to treating one or more items of packaging (e.g., containers, filler and protective material, marking, documents) as pick items that are received by an operator at a pack station, in an analogous manner to picked items that are to be packaged. For example, some embodiments include mechanisms for providing an operator at a packing station an appropriately sized shipping container, along with the picked goods that the operator will be packing into the container. As such, the operator receives the container as if it were a picked good, and the operator is relieved from the duties of determining an appropriate container size for an order, and any related tasks (e.g., ascertaining item sizes, inputting a desired container size, etc.).

In one embodiment, the operator may receive previously-picked goods in a temporary internal carrier (e.g., bin, tote, cart, pallet), along with a container that has been specifically-generated for the previously-picked goods, or that has been determined to be appropriately sized for the previously-picked goods. The operator may also receive any filling/protective materials that are appropriate for packing the previously-picked goods in the container. The operator may also receive printed or other items, such as labels, packing slips, marketing, RFID tags, etc. for packing with the items and/or for affixing to the outside of the container. As such, the operator need only assemble the container (if necessary) and pack the previously-picked goods in the container. In this example, the previously-picked goods, the container, and any filler/protective material or printed items may be sent to the operator using the same path (e.g., the same conveyer belt). Alternatively, these items may be sent to the operator using a plurality of paths (e.g., different conveyer belts).

In another embodiment, the operator may receive previously-picked goods in the actual container in which they will be packaged (e.g., a container that has been specifically-generated for the previously-picked goods, or that has been determined to be appropriately sized for the previously-picked goods). The operator may also receive any filling/protective materials that are appropriate for packing the previously-picked goods in the container, and/or printed items. As such, the packer/operator need only pack the previously-picked goods in the container.

In some embodiments, a packaging container is received at a packing station flat. For example, if the packaging container is received on an internal carrier, it may be placed in a therefore specifically purposed holder (e.g., on the side of a cart, tote, bin, or pallet). In case the carrier can handle more orders, the holder may accommodate more packaging, preferably sorted in the same sequence as the orders on the carrier, all with the purpose to make the packing process more efficient. Alternatively, the flat packaging container may be received on a conveyer—either one specific for packing material (i.e., a hanging conveyor system) or the same conveyer on which goods are received. In other embodiments, a packaging container is received at a packing station erected. For example, if the packaging container is received on an internal carrier, it may be placed inside a tote or bin, and may be on top of goods, up-side-down over goods, or with top flaps back-folded to reduce height.

Alternatively, the erected packaging container may be received alone on a conveyer (either one specific for packaging material, or the same conveyer that is used for goods).

Figure 2:
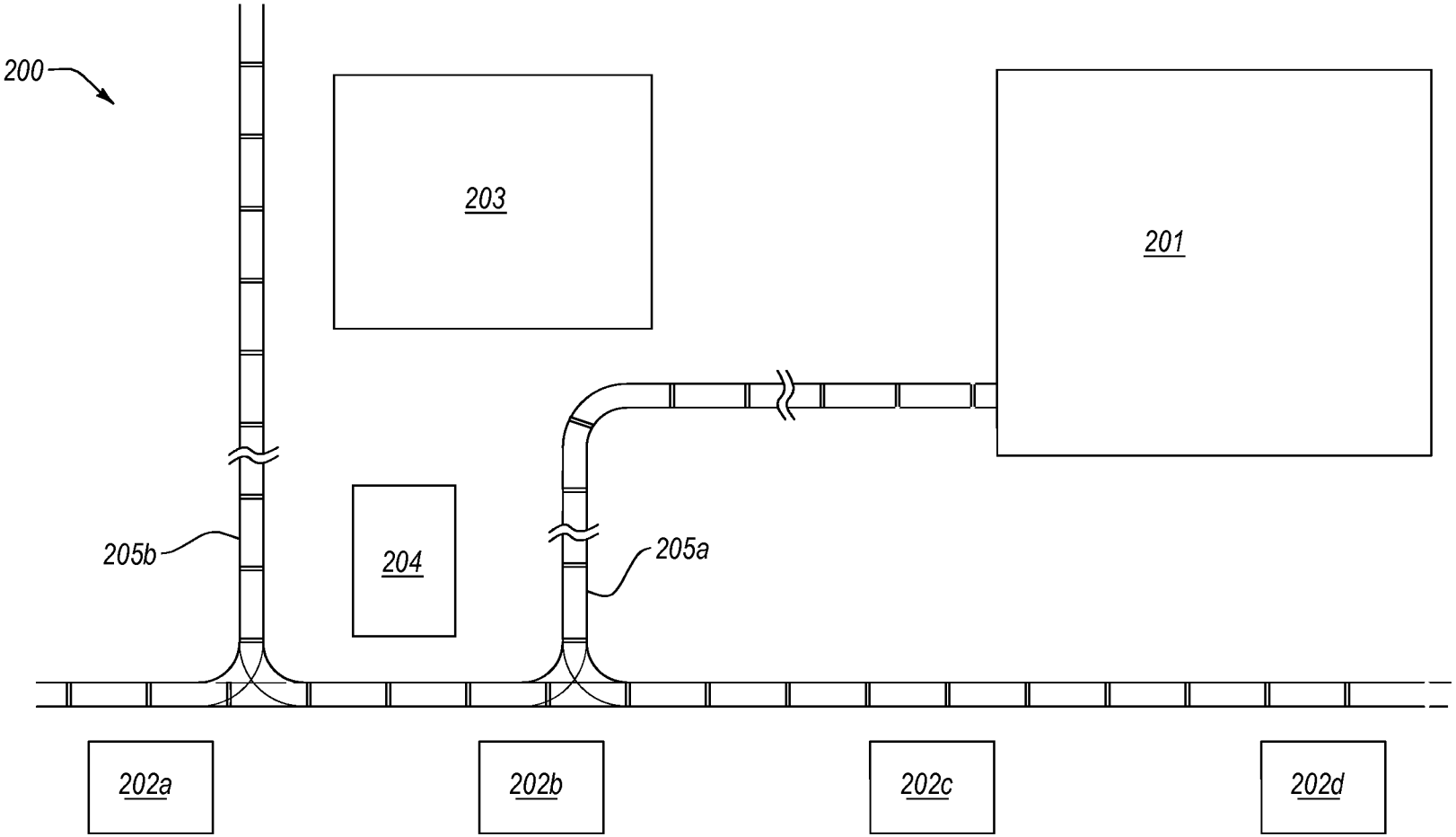
FIG. 2 is a schematic illustration of a fulfillment center that may be employed in some embodiments.

FIG. 2 schematically illustrates one example arrangement of a fulfillment center 200 that may be employed in some embodiments. In the illustrated arrangement, the fulfillment center 200 includes an inventory area 201 that may be used to store inventory of items that may eventually be packaged and shipped from the fulfillment center 200. The inventory area 201 may include shelves, racks, bins, or the like that may be used to store and/or sort the items in the inventory.

The illustrated fulfillment center 200 also includes multiple pack stations 202 (e.g., 202*a*, 202*b*, 202*c*, 202*d*) where operators may package previously-picked goods into containers. In the illustrated embodiment, the pack stations 202 are arranged adjacent to one another and at least somewhat remote from the inventory area 201. This is merely exemplary. For instance, the pack stations 202 may be located remote from one another. In some embodiments, the pack stations 202 may be located adjacent to and/or distributed about the inventory area 201.

As noted herein, a fulfillment center may be more efficient if an ODP system supplies containers to multiple pack stations, rather than providing each pack station with a dedicated ODP system that may sit idle much of the time. Accordingly, the illustrated fulfillment center 200 includes an ODP system 203 that supplies containers to all of the pack stations 202. Similarly, the illustrated fulfillment center 200 includes an area 204 where filling/protective materials, labels, packing slips, marketing, RFID tags, etc. may be stored and/or printed. Although the area 204 and the ODP system 203 are shown separate and apart from one another, in some embodiments, the area 204 and the ODP system 203 may be incorporated into a single system or area.

The illustrated fulfillment center 200 also includes conveyors 205 (e.g., 205*a*, 205*b*) that may be used to transport items from the inventory area 201 to the pack stations 202 and/or transport containers from the ODP system 203 to the pack stations 202. For instance, previously-picked items from the inventory area 201 may be transported to the pack stations 202 via conveyor 205*a*. During the transport of the previously-picked items, a container (for packing the previously-picked items in) from the ODP system 203 may be added to the previously-picked items so that the previously-picked items and the container arrive together at the pack stations. Alternatively, the previously-picked items may be transported to the pack stations 202 via conveyor 205*a* while a container (for packing the previously-picked items in) from the ODP system 203 may be transported to the pack stations 202 via conveyor 205*b*. Filling/protective materials, labels, packing slips, marketing, RFID tags, etc. may similarly be transported from area 204 to the pack stations 202 via conveyors 205, either with the previously-picked items and/or containers or separately.

Figure 3:
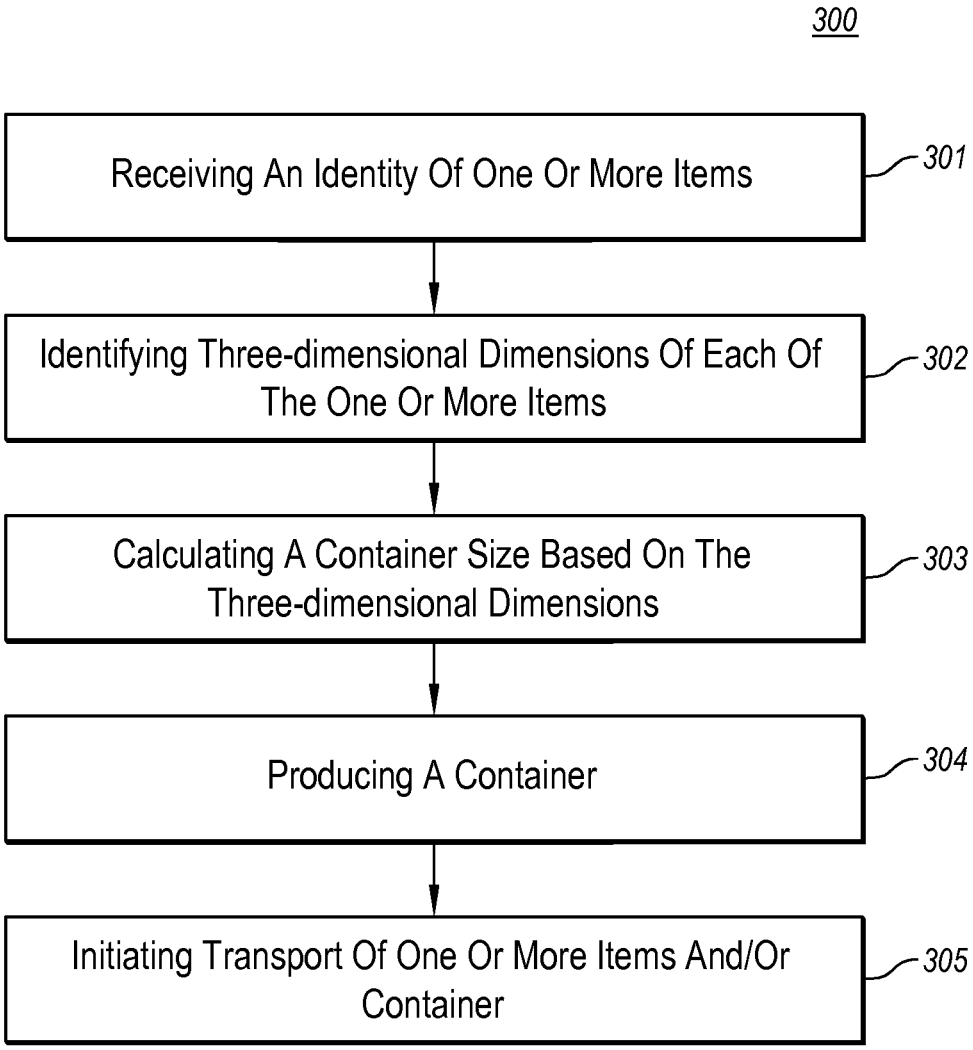
FIG. 3 is a flow chart of an example method for producing packaging materials for packaging one or more items.

In view of the foregoing, FIG. 3 illustrates a flow chart of an example method 300 for producing and routing packaging materials for packaging one or more items.

Method 300 comprises an act 301 of receiving an identity of one or more items. Act 301 can include receiving an identity of one or more items that are to be packaged into a container. For example, a computer system can receive an order, such as a purchase order, that includes a plurality of items.

Method 300 comprises an act 302 of identifying three-dimensional dimensions of each of the one or more items. Act 302 can include identifying corresponding three-dimensional dimensions of each of the one or more items. In some embodiments, the computer system looks up the dimensions of one more of the items in a database. In other embodiments, the computer system prompts a user to enter the dimensions of one or more of the items manually. In yet other embodiments, the individual or collective dimensions of the one or more items can also be measured in a manual or automatic process (e.g., stationary or in-line three-dimensional scanners).

Method 300 comprises an act 303 of calculating a container size based on the three-dimensional dimensions. Act 303 can include calculating a container size of the container based on the corresponding three-dimensional dimensions of each of the one or more items, the calculated container size being substantially equal to three-dimensional dimensions of a three-dimensional arrangement of the one or more items so that the container size accommodates all of the one or more items within the container. For example, if the one or more items include a single item, the computer system can calculate a container size that is substantially equal to the size of the single item so that the container would accommodate the single item, while potentially accounting for filler or protective material.

Frequently, the one or more items may comprise a plurality of items. In such a case, the computer system can determine a three-dimensional arrangement of the items, and calculate a container size that is substantially equal to three-dimensional dimensions of the three-dimensional arrangement of the items so that the container accommodates the three-dimensional arrangement, while potentially accounting for filler or protective material (around the items and/or between the items). As such, method 300 can include calculating a three-dimensional arrangement of the plurality of items based on the corresponding three-dimensional dimensions of each of the plurality of items, calculating three-dimensional dimensions of the three-dimensional arrangement of the plurality of items. Then, calculating the container size of the container comprises calculating a container size that is substantially equal the calculated three-dimensional dimensions so that the container will accommodate the three-dimensional dimensions of the three-dimensional arrangement of the plurality of items.

In some embodiments, the calculated three-dimensional arrangement of the plurality of items is communicated to a human operator, in digital or printed form, to assist the operator in packing the items in the container. Such communication may include illustrations, an order in which items should be packaged, special considerations for some items (e.g., a notice that an item is hazardous or fragile, instructions to use extra protective material for a fragile item, instructions to position an item in a certain orientation in the container (e.g., position a fluid containing item in an upright orientation in the container)), etc. In some instances, the communications are printed instructions or illustrations. In other instances, the communications are presented on a display to an operator at a pack station. In still other instances, the communications may include operator training to package items in containers in a specific manner. For instance, operators may be trained to package fluid containing items in an upright orientation in a container or to package fragile items in the center of container. Thus, such communications may be considered protective materials.

In some embodiments, the three-dimensional arrangement of the plurality of items is calculated so as to minimize a volume occupied by the plurality of items. However, other arrangement goals may be used, such as ease of packing, weight distribution considerations, fragility/durability considerations, creating an arrangement that fits within preexisting containers, desired orientation of items (upright orientation of fluid containing items), etc.

Method 300 comprises an act 304 of producing a container. Act 304 can include producing the container, the container having a size that is substantially equal to the calculated container size. For example, the computer system can initiate production of a container with an ODP system, or can select a pre-made container from an inventory. As such, when a container is to be produced, act 304 can include initiating production of the container, the container having the determined container size. Alternatively, when a container is to be selected from an inventory, act 304 can include associating the one or more items with a particular container that already exists within an inventory of containers, the particular container having a size that is substantially equal to the calculated container size.

Method 300 comprises an act 305 of initiating the transport of the one or more items and/or the container. As part of act 304, the computer system can initiate the sending of the one or more items and a particular container having at least the calculated container size to a pack station. For example, the computer system can provide instructions to a machine or a human user to place the item(s) and container on one or more transport mechanisms, such as conveyers. In some embodiments, act 304 initiates the transport of the one or more items and the container such that the one or more items and the container are transported together to the pack station. In other embodiments, act 304 initiates the transport of the one or more items and the container such that the one or more items and the container are transported separately to the pack station. In such embodiments, act 304 can also include coordinating the transport of the one or more items and the container such that the one or more items and the container arrive at the pack station at about the same time.

Additional embodiments include calculating an amount of filler/protective material needed to package items of an order in a given container. For example, in connection with computing the dimensions of items to be packed in a container, a computer system can compute how much filler/protective material is appropriate for packaging the items in the container. Computing such amounts of filler/protective material can include computing an amount of filler/protective material that should surround an item or a group of items, and an amount of filler/protective material that should be used between items.

In some embodiments, the computer system looks up (e.g., in a database) or prompts a user for data regarding a durability/fragility of an item or items. Such durability/fragility data can be used to adjust the type and/or amount of filler/protective material used. Some embodiments employ a feedback loop, utilizing actual data from customers and/or carriers specifying whether a specific item or specific shipment has had problems before. Thus, if an item/shipment has had problems in the past, it may be determined that a higher level of protection is needed. Factors affecting protection level could include varying the content of the shipment, varying the amount and/or type of protective materials used, and/or packaging design, marking of fragility, or varying shipping distance and/or route to destination. Similarly, in some embodiments, the computer system looks up (e.g., in a database) or prompts a user for data regarding desired packaging position(s)/orientation(s) for item(s). Such data can be used to adjust how the item(s) is/are packaged in the container.

In accordance with the foregoing, method 300 may include an act of calculating a quantity of protective packaging material for use when packaging the one or more items within the container. In addition, method 300 may include an act of initiating the sending of protective packaging material to the pack station along with the one or more items and the particular container. For example, a central filler dispensing machine can dispense an appropriate amount of filler/protective material for packaging one or more items in a container, and send that filler/protective material to a packing station (e.g., by instruction to a human or a computer to place the filler on a transport, in the container, etc.). In some embodiments, packaging instructions are printed regarding the manner in which the item(s) are to be packaged in the container (e.g., wrapping in protective material, orientation/arrangement of items in container). In some embodiments, packaging instructions are sent to a display at a pack station so that an operator may view the instructions on the display.

As discussed above, embodiments can also include providing printed material, identification items, etc. as a pick item. For example, in connection with processing an order of one or more items, the computer system can initiate generation of shipping labels, RFID tags, postage, advertising, etc. for use in connection with packing the container. As such, the method 300 may include an act of initiating the sending of printed material to the pack station along with the one or more items and the particular container, and/or an act of initiating the sending of a digital identification tag to the pack station along with the one or more items and the particular container.

By way of example, in one implementation, an order for one or more items is received. The order may be from a customer desiring to purchase the one or more items. As part of receiving the order, the identity of the one or more items is/are identified. With the identity of the one or more items identified, the one or more items are picked from an inventory of items. For instance, warehouse personnel or an automated system (e.g., conveyors, robots, etc.) may retrieve or pick the one or more items from warehouse shelves or the like.

Prior to or during the picking process, the three-dimensional dimensions of each of the one or more items may be identified, as discussed herein. Likewise, prior to or during the picking process, a container size may be calculated based on the three-dimensional dimensions of each of the one or more items, as also discussed herein. The container of the calculated size may then be selected from an inventory of containers or may be produced (e.g., by an ODP station).

In some embodiments, the warehouse personnel or automated system that picks the one or more items also retrieves or picks the selected/produced container while picking the one or more items. In other embodiments, the warehouse personnel or automated system that picks the one or more items retrieves or picks the selected/produced container after picking the one or more items. Similarly, the warehouse personnel or automated system may also retrieve or pick other packaging items (e.g., filler and protective material, marking, documents) during or after the picking of the one or more items. In still other embodiments, the one or more items and the selected/produced container are picked by separate warehouse personnel or automated systems.

Once the one or more items and the selected/produced container are picked, the one or more items and the selected/produced container are delivered to a packing station (e.g., by the one or more warehouse personnel or automated systems). At the packing station, the selected/produced container is assembled, if necessary. The one or more items are then packaged in the assembled container, along with any needed filler and protective material and documents (e.g., receipt, packing slip, etc.). The container may then be sealed and, if necessary, labeled (e.g., with a shipping label), and shipped out.

The foregoing embodiments eliminate the need for an ODP system, filler dispensers, and printers to exist at each packing station. Instead, these items can exist at a centralized location, and can be used to provide containers and other materials to a plurality of packing stations. As such, the ODP systems may be used to their fullest extent, given current demand. Detaching ODP systems and other hardware from packing stations can reduce the overall number of ODP systems needed to generate containers for a given fulfillment workload, and can produce savings in terms of real estate and capital expenditures. The foregoing also eliminates the need to store bulky packaging material (e.g., containers, corrugated fiberboard, etc.) at packing stations, further producing savings in terms of real estate.

Although the subject matter has been described in language specific to structural features and/or methodological acts, it is to be understood that the subject matter defined in the appended claims is not necessarily limited to the described features or acts described above, or the order of the acts described above. Rather, the described features and acts are disclosed as example forms of implementing the claims.

Embodiments of the present invention may comprise or utilize a special-purpose or general-purpose computer system that includes computer hardware, such as, for example, one or more processors and system memory, as discussed in greater detail below. Embodiments within the scope of the present invention also include physical and other computer-readable media for carrying or storing computer-executable instructions and/or data structures. Such computer-readable media can be any available media that can be accessed by a general-purpose or special-purpose computer system. Computer-readable media that store computer-executable instructions and/or data structures are computer storage media. Computer-readable media that carry computer-executable instructions and/or data structures are transmission media. Thus, by way of example, and not limitation, embodiments of the invention can comprise at least two distinctly different kinds of computer-readable media: computer storage media and transmission media.

Computer storage media are physical storage media that store computer-executable instructions and/or data structures. Physical storage media include computer hardware, such as RAM, ROM, EEPROM, solid state drives ("SSDs"), flash memory, phase-change memory ("PCM"), optical disk storage, magnetic disk storage or other magnetic storage devices, or any other hardware storage device(s) which can be used to store program code in the form of computer-executable instructions or data structures, which can be accessed and executed by a general-purpose or special-purpose computer system to implement the disclosed functionality of the invention.

Transmission media can include a network and/or data links which can be used to carry program code in the form of computer-executable instructions or data structures, and which can be accessed by a general-purpose or special-purpose computer system. A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer system, the computer system may view the connection as transmission media. Combinations of the above should also be included within the scope of computer-readable media.

Further, upon reaching various computer system components, program code in the form of computer-executable instructions or data structures can be transferred automatically from transmission media to computer storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media can be included in computer system components that also (or even primarily) utilize transmission media.

Computer-executable instructions comprise, for example, instructions and data which, when executed at one or more processors, cause a general-purpose computer system, special-purpose computer system, or special-purpose processing device to perform a certain function or group of functions. Computer-executable instructions may be, for example, binaries, intermediate format instructions such as assembly language, or even source code.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, tablets, pagers, routers, switches, and the like. The invention may also be practiced in distributed system environments where local and remote computer systems, which are linked (either by hardwired data links, wireless data links, or by a combination of hardwired and wireless data links) through a network, both perform tasks. As such, in a distributed system environment, a computer system may include a plurality of constituent computer systems. In a distributed system environment, program modules may be located in both local and remote memory storage devices.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A computer system, comprising:

one or more processors;

one or more computer-readable media storing computer-executable instructions that, when executed by the one or more processors, cause the computer system to initiate the production of packaging materials for packaging one or more items, including the following:

receiving an identity of one or more items that are to be packaged into a container;

initiating the retrieval of the one or more items from an inventory of items;

identifying corresponding three-dimensional dimensions of each of the one or more items;

calculating a container size of the container based on the corresponding three-dimensional dimensions of each of the one or more items, the calculated container size being substantially equal to three-dimensional dimensions of a three-dimensional arrangement the one or more items such that the container size accommodates all of the one or more items within the container;

producing the container, the container having a size substantially equal to at least the calculated container size;

initiating the retrieval of the container;

calculating a quantity of protective packaging material for the packaging the one or more items within the container;

initiating the retrieval of the calculated quantity of protective packaging material; and initiating the individual delivery of the one or more items, the calculated quantity of protective packaging material, and the container to a pack station, wherein initiating the individual delivery of the one or more items, the calculated quantity of protective packaging material, and the container to the pack station comprises providing instructions to place the one or more items, the calculated quantity of protective packaging material, and container separately on one or more transport mechanisms and coordinating the transport of the one or more items, the calculated quantity of protective packaging material, and the container such that the one or more items, the calculated quantity of protective packaging material, and the container arrive individually at the pack station at approximately the same time, wherein the one or more items and the calculated quantity of protective packaging material are packaged in the container at the pack station.

2. The computer system as recited in claim 1, wherein the one or more items comprise a plurality of items, the method further comprising:

calculating a three-dimensional arrangement of the plurality of items based on the corresponding three-dimensional dimensions of each of the plurality of items; and calculating three-dimensional dimensions of the three-dimensional arrangement of the plurality of items, wherein calculating the container size of the container comprises calculating a container size that is substantially equal to the three-dimensional dimensions of the three-dimensional arrangement of the plurality of items.

3. The computer system as recited in claim 2, wherein calculating the three-dimensional arrangement of the plurality of items comprises:

calculating the three-dimensional arrangement of the plurality of items so as to minimize a volume occupied by the plurality of items.

4. The computer system as recited in claim 2, wherein calculating the three-dimensional arrangement of the plurality of items comprises at least one of:

allocating space between at least two of the plurality of items to accommodate protective packaging material; or allocating space surrounding the three-dimensional arrangement of the plurality of items to accommodate protective packaging material.

5. The computer system as recited in claim 1, wherein producing the container comprises:

initiating production of the container, the container having the calculated container size.

6. The computer system as recited in claim 1, further comprising initiating the sending of protective packaging material to the pack station along with the one or more items and the particular container.

7. The computer system as recited in claim 1, further comprising initiating the sending of printed material to the pack station along with the one or more items and the particular container.

8. The computer system as recited in claim 1, further comprising initiating the sending of a digital identification tag to the pack station along with the one or more items and the particular container.

9. The computer system as recited in claim 1, further comprising physically associating the one or more items and the container with one another prior to initiating the delivery of the one or more items and the container to the pack station.

10. The computer system as recited in claim 9, wherein physically associating the one or more items and the container with one another comprises placing the one or more items in the container during the retrieval of the one or more items from the inventory of items.

11. The computer system as recited in claim 1, wherein initiating the delivery of the one or more items and the container to the pack station comprises associating the one or more items and the container such that the one or more items and the container are transported together to the pack station.

12. A computer system, comprising:

one or more processors;

one or more computer-readable media storing computer-executable instructions that, when executed by the one or more processors, cause the computer system to initiate the production of packaging materials for packaging one or more items, including the following:

receiving an identity of one or more items that are to be packaged into a container;

initiating the retrieval of the one or more items from an inventory of items;

identifying corresponding three-dimensional dimensions of each of the one or more items;

calculating a container size of the container based on the corresponding three-dimensional dimensions of each of the one or more items, the calculated container size being substantially equal to three-dimensional dimensions of a three-dimensional arrangement the one or more items such that the container size accommodates all of the one or more items within the container;

producing the container, the container having a size substantially equal to at least the calculated container size;

initiating the retrieval of the container from an on-demand packaging system;

calculating a quantity of protective packaging material for the packaging the one or more items within the container;

initiating the retrieval of the calculated quantity of protective packaging material;

selecting a pack station from among a plurality of pack stations; and initiating the individual delivery of the one or more items, the calculated quantity of protective packaging material, and the container to the selected pack station, wherein initiating the individual delivery of the one or more items, the calculated quantity of protective packaging material, and the container to the selected pack station comprises providing instructions to place the one or more items, the calculated quantity of protective packaging material, and container separately on one or more transport mechanisms and coordinating the transport of the one or more items, the calculated quantity of protective packaging material, and the container such that the one or more items, the calculated quantity of protective packaging material, and the container arrive individually at the selected pack station at approximately the same time, wherein the one or more items and the calculated quantity of protective packaging material are packaged in the container at the pack station.

13. The computer system as recited in claim 12, wherein the one or more items comprise a plurality of items, the method further comprising:

calculating a three-dimensional arrangement of the plurality of items based on the corresponding three-dimensional dimensions of each of the plurality of items; and calculating three-dimensional dimensions of the three-dimensional arrangement of the plurality of items, wherein calculating the container size of the container comprises calculating a container size that is substantially equal to the three-dimensional dimensions of the three-dimensional arrangement of the plurality of items.

14. The computer system as recited in claim 13, wherein calculating the three-dimensional arrangement of the plurality of items comprises:

calculating the three-dimensional arrangement of the plurality of items so as to minimize a volume occupied by the plurality of items.

15. The computer system as recited in claim 13, wherein calculating the three-dimensional arrangement of the plurality of items comprises at least one of:

allocating space between at least two of the plurality of items to accommodate protective packaging material; or allocating space surrounding the three-dimensional arrangement of the plurality of items to accommodate protective packaging material.

16. The computer system as recited in claim 12, wherein producing the container comprises:

initiating production of the container, the container having the calculated container size.

17. The computer system as recited in claim 12, further comprising initiating the sending of protective packaging material to the pack station along with the one or more items and the particular container.

18. The computer system as recited in claim 12, further comprising initiating the sending of printed material to the pack station along with the one or more items and the particular container.

19. The computer system as recited in claim 12, further comprising initiating the sending of a digital identification tag to the pack station along with the one or more items and the particular container.

20. The computer system as recited in claim 12, further comprising physically associating the one or more items and the container with one another prior to initiating the delivery of the one or more items and the container to the selected pack station.

21. The computer system as recited in claim 20, wherein physically associating the one or more items and the container with one another comprises placing the one or more items in the container during the retrieval of the one or more items from the inventory of items.

22. The computer system as recited in claim 12, wherein initiating the delivery of the one or more items and the container to the selected pack station comprises associating the one or more items and the container such that the one or more items and the container are transported together to the pack station.

23. A packaging system, comprising:

an on-demand packaging system configured to dynamically produce containers that are custom-sized for items of particular orders;

a plurality of pack stations associated with the on-demand packaging system, each of the plurality of pack stations being configured to receive custom-sized containers and items associated with particular orders for packaging of the items in the custom-sized containers; and a computer system comprising:

one or more processors;

one or more computer-readable media storing computer-executable instructions that, when executed by the one or more processors, cause the computer system to initiate the production of packaging materials for packaging one or more items, including the following:

receiving an identity of one or more items that are to be packaged into a container;

initiating the retrieval of the one or more items from an inventory of items;

identifying corresponding three-dimensional dimensions of each of the one or more items;

calculating a container size of the container based on the corresponding three-dimensional dimensions of each of the one or more items, the calculated container size being substantially equal to three-dimensional dimensions of a three-dimensional arrangement the one or more items such that the container size accommodates all of the one or more items within the container;

producing the container at the on-demand packaging system, the container having a size substantially equal to at least the calculated container size;

initiating the retrieval of the container from the on-demand packaging system;

calculating a quantity of protective packaging material for the packaging the one or more items within the container;

initiating the retrieval of the calculated quantity of protective packaging material selecting a pack station from among the plurality of pack stations; and initiating the individual delivery of the one or more items, the calculated quantity of protective packaging material, and the container to the selected pack station, wherein initiating the individual delivery of the one or more items, the calculated quantity of protective packaging material, and the container to the selected pack station comprises providing instructions to place the one or more items, the calculated quantity of protective packaging material, and container separately on one or more transport mechanisms and coordinating the transport of the one or more items, the calculated quantity of protective packaging material, and the container such that the one or more items, the calculated quantity of protective packaging material, and the container arrive individually at the selected pack station at approximately the same time, wherein the one or more items and the calculated quantity of protective packaging material are packaged in the container at the pack station.

24. The system as recited in claim 23, further comprising one or more of:

initiating the sending of printed material to the pack station along with the one or more items and the particular container; and initiating the sending of a digital identification tag to the pack station along with the one or more items and the particular container.

25. The system as recited in claim 23, further comprising physically associating the one or more items and the container with one another prior to initiating the delivery of the one or more items and the container to the selected pack station.

26. The system as recited in claim 25, wherein physically associating the one or more items and the container with one another comprises placing the one or more items in the container during the retrieval of the one or more items from the inventory of items.

27. The system as recited in claim 23, wherein initiating the delivery of the one or more items and the container to the selected pack station comprises associating the one or more items and the container such that the one or more items and the container are transported together to the pack station.

* * * * *